US005622237A

United States Patent [19]

Moldow

[11] Patent Number: 5,622,237

[45] Date of Patent: Apr. 22, 1997

[54] PORTABLE HOIST SYSTEM

[75] Inventor: Steffen Moldow, Reston, Va.

[73] Assignee: Rollgliss, Inc., Great Falls, Va.

[21] Appl. No.: 550,350

[22] Filed: Oct. 30, 1995

[51] Int. Cl.[6] ..... E04G 3/14

[52] U.S. Cl. ..... 182/37; 212/179; 212/224

[58] Field of Search ..... 182/36, 37; 212/179, 212/224; 187/239, 240

[56] References Cited

U.S. PATENT DOCUMENTS 2,569,821 10/1951 Maxeiner .
2,696,917 12/1954 Kershaw .
4,270,628 6/1981 Anderson ..... 182/37 X
4,621,741 11/1986 Boom ..... 212/179 X
5,271,481 12/1993 Rich ..... 182/36 X
5,341,898 8/1994 Baziuk ..... 182/142

*Primary Examiner*—Ramon O. Ramirez
*Attorney, Agent, or Firm*—Dowell & Dowell

[57] ABSTRACT

A portable hoist system suitable for mounting to a pair of rails includes a vertical support, an inclined boom connected to the vertical support and a hoist secured to the boom. Clamping members are provided at the lower ends of the vertical support and the boom for detachably mounting to the rails. The hoist system is preferably foldable for transport or storage purposes.

20 Claims, 5 Drawing Sheets

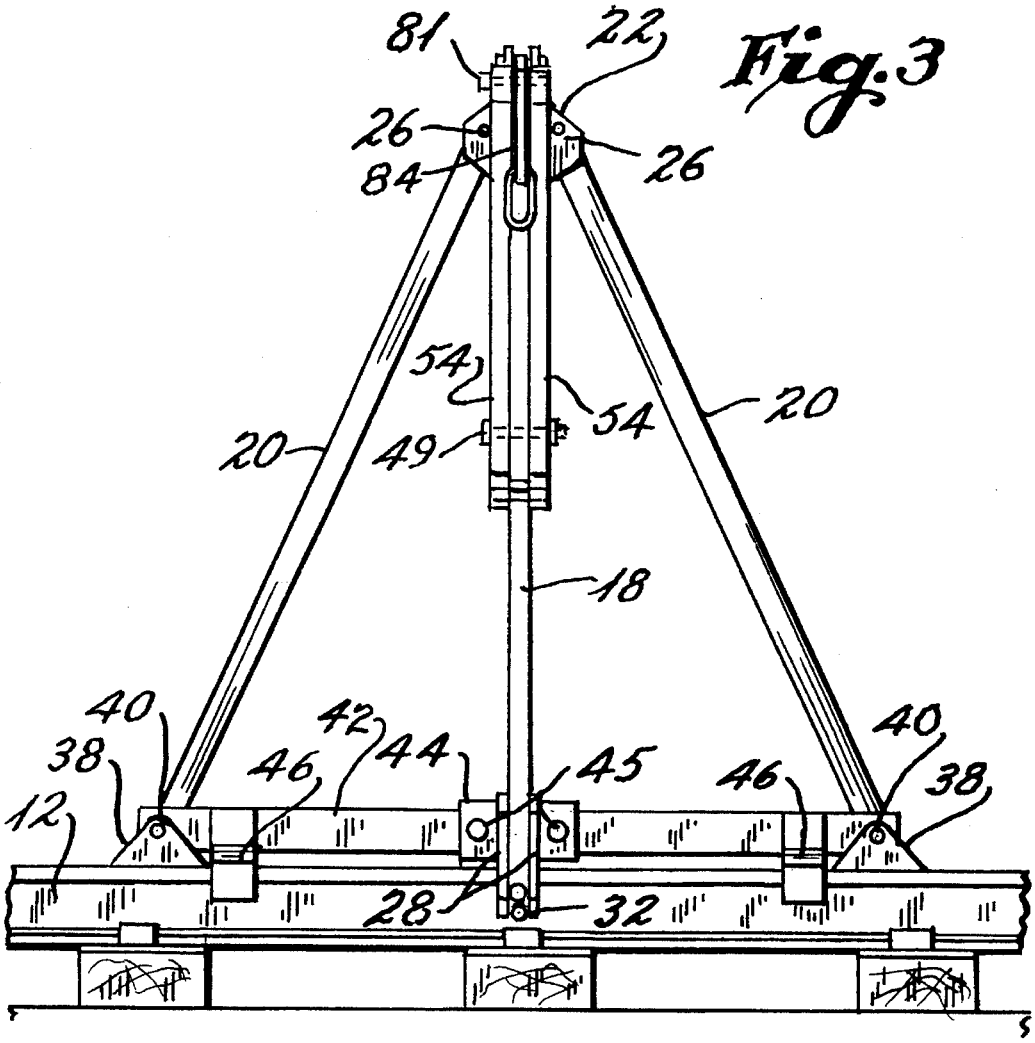
Fig.3
Fig.5
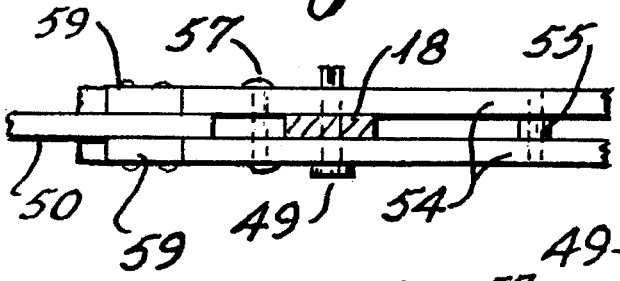
Fig.6
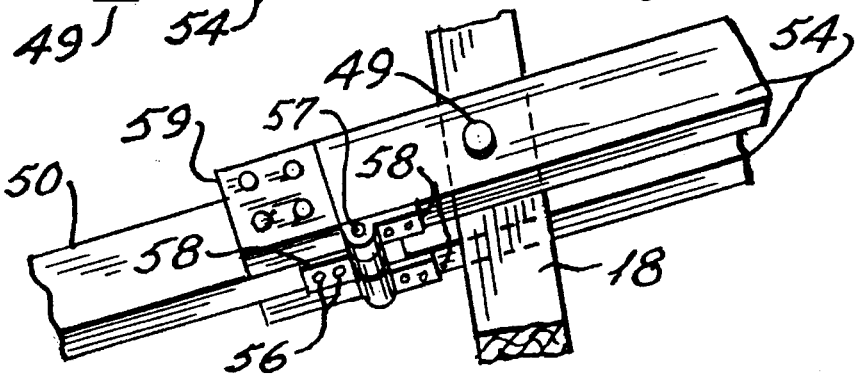

84
81
54
80
17
38
46
42
38
42
46
12
74
76
50
72
78
14
62
62
66

PORTABLE HOIST SYSTEM

BACKGROUND OF THE INVENTION

1. Field of the Invention

The invention relates to the field of hoists and, more particularly, to a portable hoist system for mounting to rails.

2. Background of the Related Art

Safety and rescue workers such as fireman are commonly confronted with situations where it is necessary to raise or lower persons and objects between different elevations, such as between the ground level and an upper level of tall structures such as buildings and bridges. During rescue operations, it is frequently impossible to access tall structures using a conventional vehicle-mounted ladder or elevated platform due to time, space or safety concerns.

Portable lifting devices are known for use on the roofs of buildings to lift or lower objects. For example, U.S. Pat. No. 5,341,898 to Baziuk and U.S. Pat. No. 2,569,821 to Maxeiner disclose portable lifting devices which are foldable or collapsible, and constructed to be supported by a roof surface without fixed attachment.

U.S. Pat. No. 4,270,628 to Anderson discloses an elevator device comprised of a trolley permanently attached to a pair of rails which are detachably secured to upstanding supports provided on roofs of buildings.

The above-described lifting devices for use on roofs of buildings are not suitable for portable use on fixed rails and, especially, on an elevated railroad bridge extending over land or water. Maintenance work and rescue operations performed on such railroad bridges involve added difficulties. While it is possible to store lifting devices on or near to roofs to have them available at all times, the same is not possible with respect to railroad bridges. Furthermore, bridges located at remote locations and lacking nearby access roads further increase the difficulty of providing lifting devices in emergencies.

Thus, in view of the above-described disadvantages associated with the known devices, there has been a need for a lifting and lowering device for objects, materials and persons which is portable, easily assembled for use and disassembled for storage or transport, and suitable for use on rails.

SUMMARY OF THE INVENTION

The present invention has been made in view of the above-described disadvantages of the known lifting devices and has an object to provide an improved hoist system which is suitable for use on rails.

It is a another object of the invention to provide a lightweight hoist system which is readily assembled and capable of being disassembled into a compact configuration for storage and transport purposes.

To achieve the objects of the invention, as embodied and broadly described herein, the hoist system in accordance with a preferred embodiment of the invention comprises a vertical support having a lower end and an upper end. A first clamping member is provided at the lower end for detachably mounting to a first rail.

A boom is connected to the vertical support and extends at an inclination relative to the horizontal. The boom has a lower end and an upper end, and a second clamping member is provided at the lower end of the boom for detachably mounting to a second rail which is parallel to the first rail. The boom preferably extends perpendicularly to the rails.

A hoist is connected to the upper end of the boom.

BRIEF DESCRIPTION OF THE DRAWINGS

In the accompanying drawings:

FIG. 3 is a partial front elevational view of the portable hoist system of FIG. 1;

FIG. 5 is a partial view taken in the direction of line 5—5 of FIG. 2;

FIG. 6 is a partial view taken in the direction of line 6—6 of FIG. 2;

DETAILED DESCRIPTION OF THE PREFERRED EMBODIMENT

Figure 1:
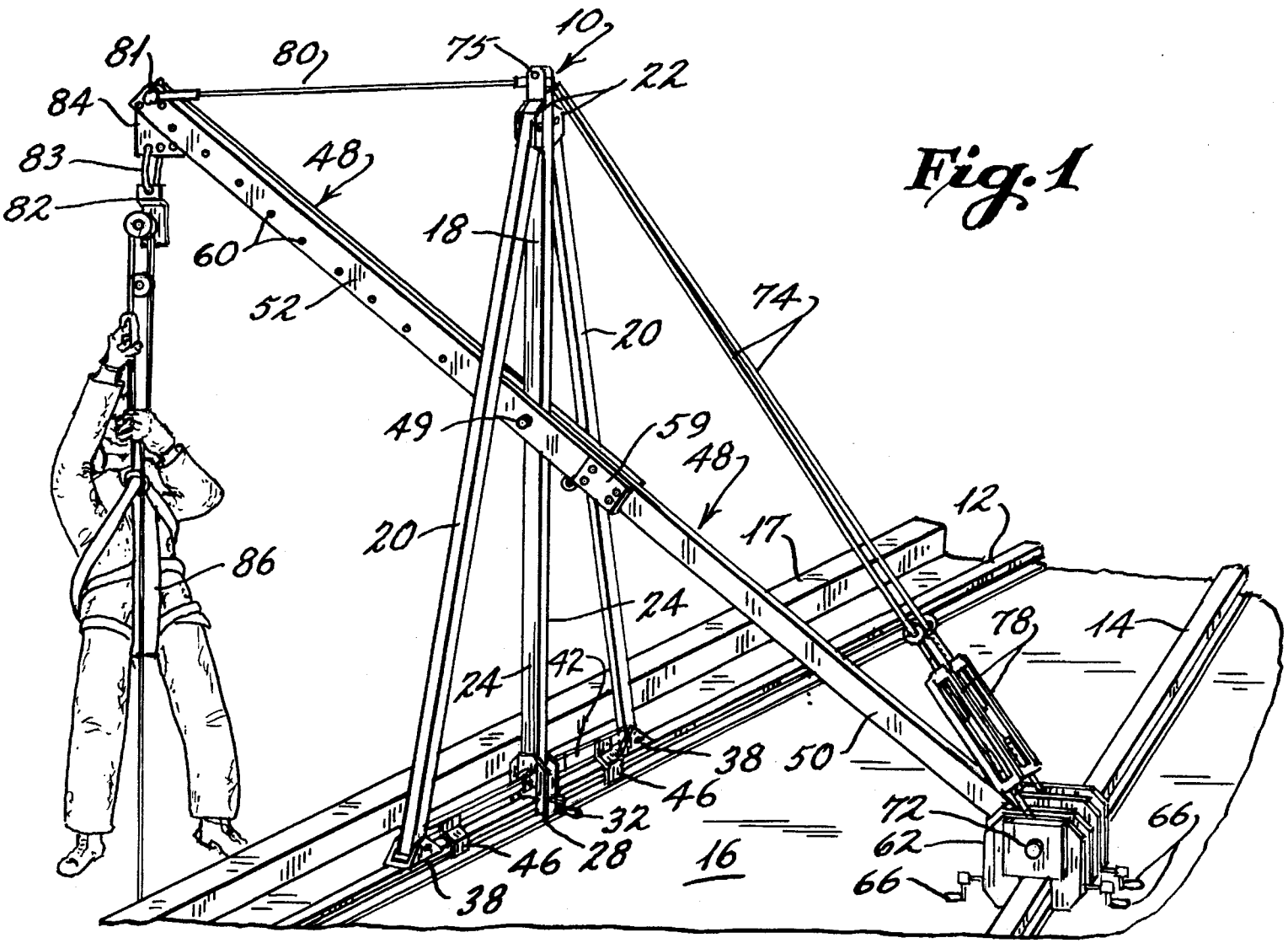
FIG. 1 is a perspective view illustrating the use of the portable hoist system in accordance with a preferred embodiment of the invention.

FIG. 1 illustrates a portable hoist system 10 in accordance with a preferred embodiment of the invention. The hoist system is shown in an assembled condition mounted to a pair of spaced, parallel rails 12, 14 of a railway bridge 16. An individual is depicted being supported by the hoist system adjacent to an edge 17 of the bridge.

The hoist system comprises a vertical support 18 and a pair of inclined stabilizing members 20 connected to an upper end of the vertical support by a connecting bracket 22. The stabilizing members extend downward from opposed sides 24 of the vertical support, such that the vertical support and the stabilizing members lie in a common vertical plane. As shown in FIG. 3, the stabilizing members are pivotally connected to the bracket 22 by fasteners 26 such as pins or the like.

Figure 2:
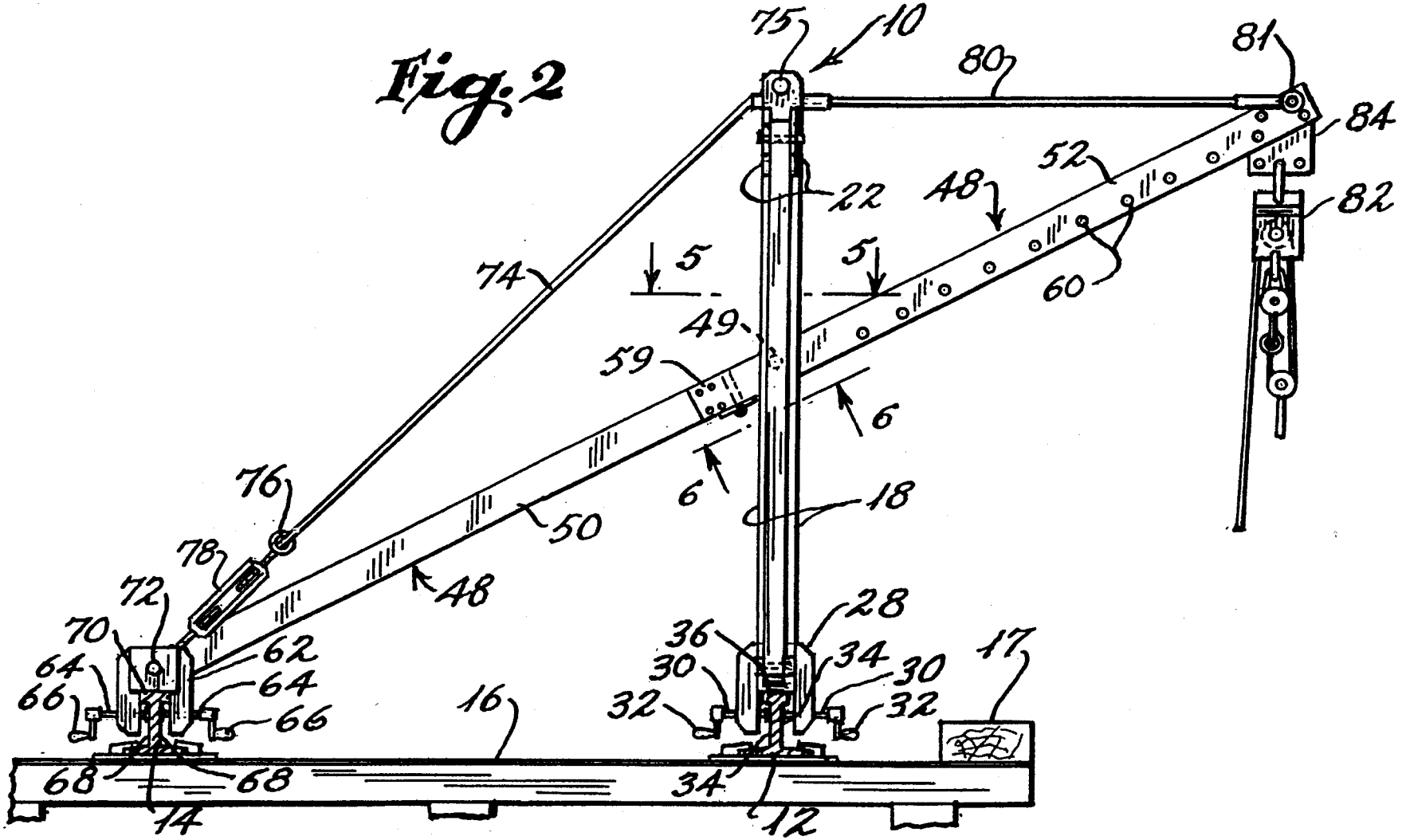
FIG. 2 is a side elevational view partially in cross-section of the portable hoist system of FIG. 1.

Referring to FIG. 2, a first clamping means is provided at the lower end of the vertical support 18 for detachably mounting to the rail 12 as shown. The first clamping means is preferably a generally U-shaped first clamping member 28 which extends downward and includes opposed threaded bolts 30 having handles 32 for moving the bolts toward and away from the opposed sides 34 of the rail. As shown, the bolts contact the rail below the enlarged upper end 36, which limits upward movement of the bolts to prevent the first clamping member from being separated from the rail during use of the hoist system.

Referring to FIG. 3, a shoe 38 is provided on the bottom end of each of the stabilizing members 20 to rest on the enlarged upper end 36 of the rail 12. The shoes are each rotatable relative to the associated stabilizing member about a fastener 40, to enable the shoes to rest firmly on uneven rail surfaces.

Preferably, a rigid horizontal stabilizer is provided to maintain the stabilizing members in a fixed inclined relationship relative to the vertical support and also enhance the stability of the hoist system. Horizontal stabilizing members 42 are connected to the lower ends of the vertical support 18 and the stabilizing members 20. The horizontal stabilizing members 42 are each fastened to a shoe 38 and an inclined stabilizing member 20 at one end by a fastener 40, and at an opposite end are attached to a bracket 44 provided on the first clamping member 28 by fasteners 45.

A vertical member 46 is provided on each horizontal stabilizing member 42 adjacent to a shoe 38. The vertical members 46 extend downward below the enlarged upper end 36 on both sides of the rail 12 and limit lateral movement of the stabilizing members 42 to prevent the shoes 38 from moving off the rail during operation of the hoist assembly.

The hoist system further comprises a boom 48 which is connected to the vertical support 18 by a fastener 49 and extends upward from the rail 14 at an acute angle relative to the horizontal, approximately perpendicular to the direction of the rails 12 and 14. The boom is comprised of a lower section 50 and an upper section 52 connected to the lower section. Additional longitudinally spaced bores (not shown) may be formed in the vertical support to enable the boom to extend at other selected inclinations.

The boom 48 is preferably foldable for storage or transport purposes. As shown in FIGS. 3–6, the upper section 52 is preferably comprised of a pair of spaced upper members 54 connected to the lower section 50 by a hinge 56. The hinge includes a pin 57 and plates 58 fastened adjacent to the lower ends of the upper members 54 and the upper end of the lower section 50. One or more spacers 55 may be positioned between the upper members along the length of the upper section. In the assembled condition of the hoist assembly as illustrated in FIG. 1, the hinge 56 and brackets 59 fastened to the upper members 54 maintain the upper and lower sections in a relatively collinear position. The boom is folded by pivoting the upper and lower sections about the hinge pivot axis.

Referring to FIG. 1, a plurality of longitudinally spaced holes 60 are formed in the upper members 54. The holes in each upper member are aligned with a respective hole in the opposite upper member.

A second clamping means is provided at the lower end of the boom 48 for detachably mounting to the rail 14. As shown in FIG. 2, the second clamping means is preferably a second generally U-shaped clamping member 62 which includes opposed threaded bolts 64 having handles 66 for moving the bolts toward and away from the opposed sides 68 of the rail 14. The bolts contact the rail below the enlarged upper end 70 of the rail, which limits upward movement of the bolts. The lower section 50 of the boom 48 is fastened to the second clamping member 62 by a fastener 72.

Figure 4:
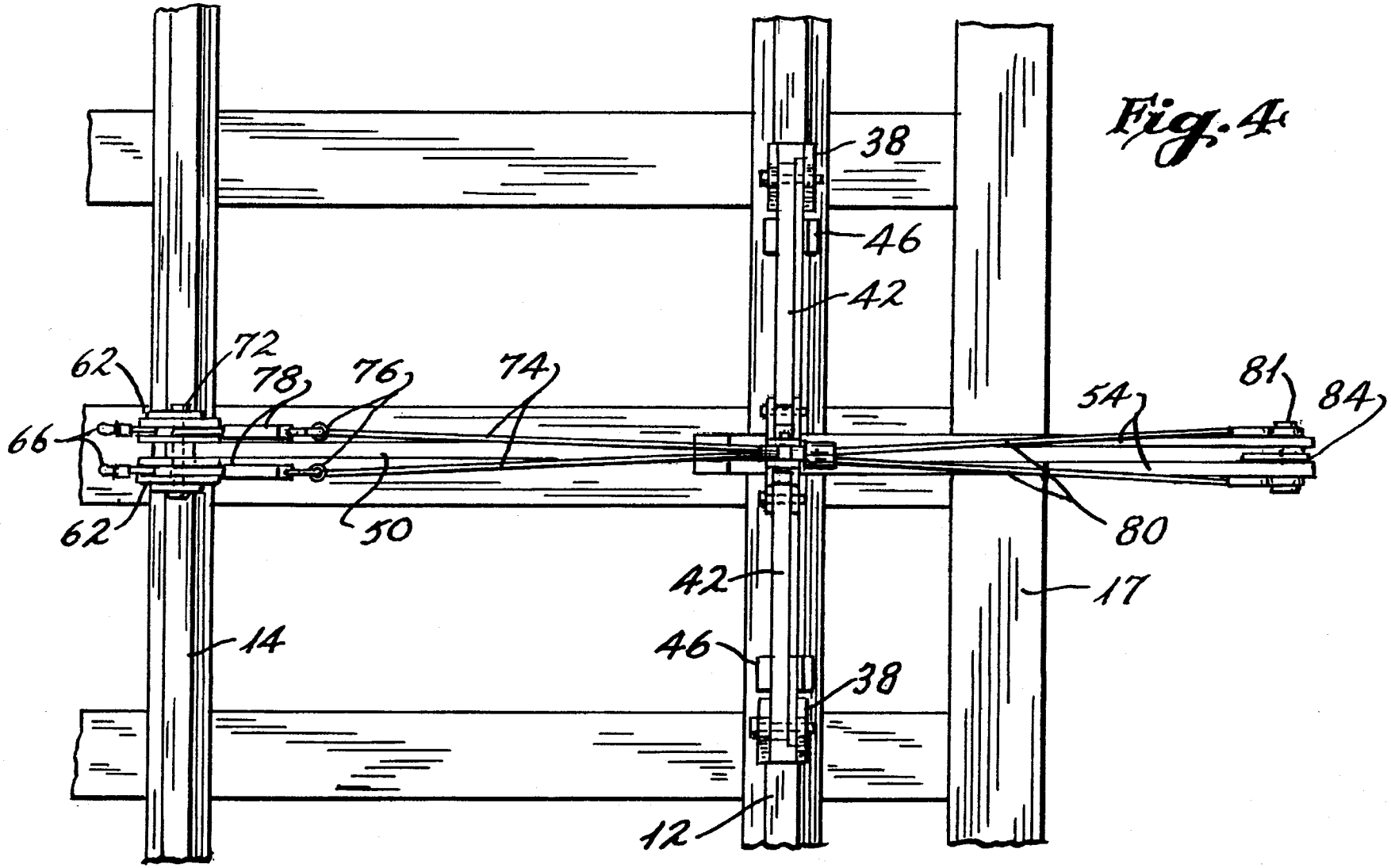
FIG. 4 is a top plan view of the portable hoist system of FIG. 1.

A first pair of cables 74 are connected at a lower end to the second clamping member 62, and at an upper end to a vertical bracket portion 75. As illustrated in FIG. 4, the lower end of each cable 74 is secured to a threaded bolt 76 which is adjustably received in a female threaded member 78 secured to the second clamping member by the fastener 72, to enable the tension in the cables 74 to be adjusted.

A second pair of cables 80 are connected to the connecting bracket 22 at one end and to the upper end of the boom 48 at an opposite end by a fastener 81. The cables 74 and 80 maintain the hoist system in a stable, upright position when supporting a load, such as illustrated in FIG. 1.

In accordance with the invention, a different number of cables 74 and 80 may optionally be used. For example, one cable may optionally be used for each of the cables 74 and 80, or a single cable may extend from the second clamping member 62 to the bracket portion 75 and to the upper end of the boom 48 (not shown). Alternatively, rigid members (not shown) such as rods providing an adjustable level of tension may be used in place of cables.

The hoist system further comprises a hoist 82 which includes a loop 83 secured to a mounting plate 84 provided on the upper section 52 of the boom 48. As shown, the hoist is preferably self-operable and includes a harness 86 for supporting an individual. The individual may be, for example, a maintenance or rescue worker, or an individual being rescued. Other types of manually operated or motorized hoists and harnesses may optionally be provided for other intended uses of the hoist system such as lifting objects and materials.

Referring to FIG. 1, the hoist 82 is connected to the upper end of the boom 48 so that the individual supported by the hoist is a safe distance from the edge 17 of the bridge 16. In those instances when there is only a narrow distance between the first clamping member 28 and the edge of the structure with respect to which the individual is being raised or lowered, the hoist may be connected to the boom by the loop 83 at a selected location closer to the first clamping member.

The hoist system is lightweight, yet capable of supporting substantial loads. Preferably, at least the vertical support 18, the inclined stabilizing members 20, the clamping members 28 and 62, the stabilizing members 42 and the boom 48 are formed of a strong, lightweight material such as aluminum or the like.

Figure 7:
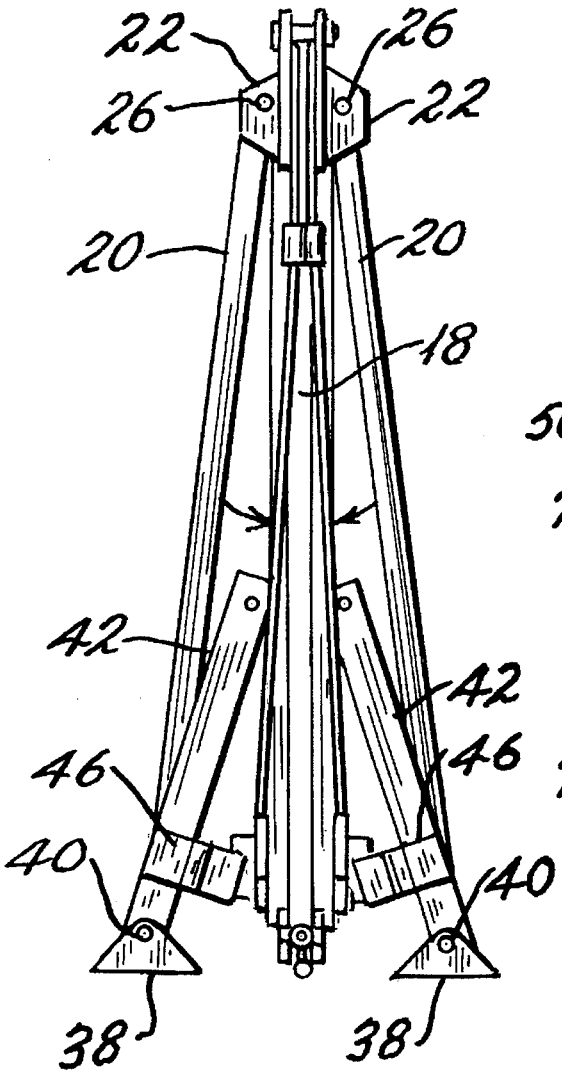
FIG. 7 is a front view illustrating the portable hoist system in a folded condition.
Figure 8:
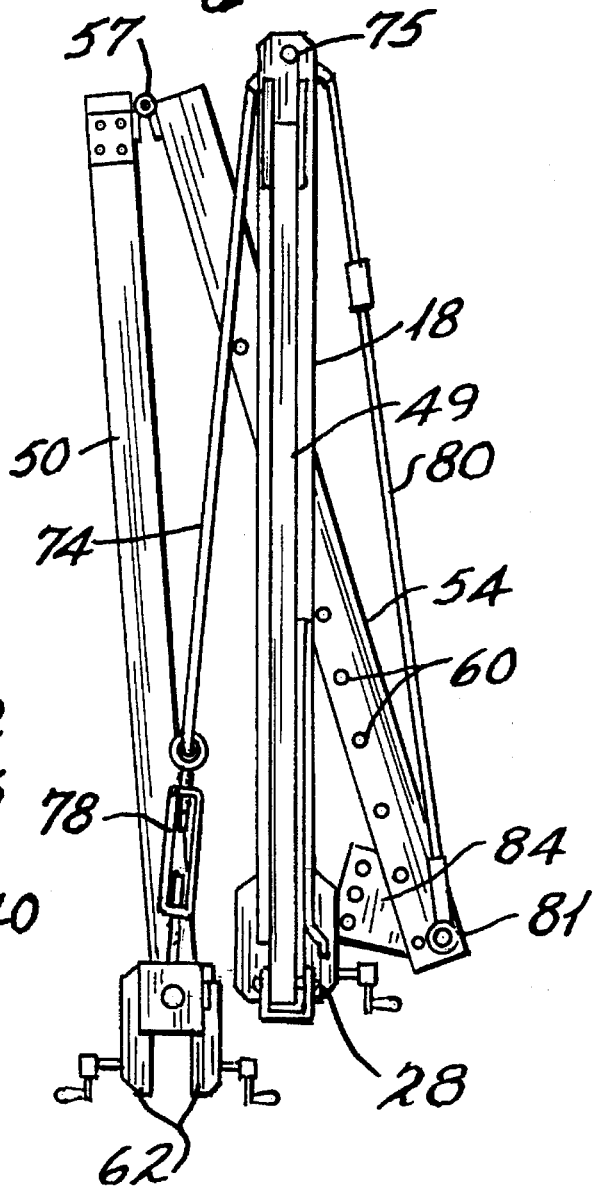
FIG. 8 is a side view of the portable hoist system in the folded condition of FIG. 7.

Referring to FIGS. 7 and 8, the hoist system is partially disassembled and placed in a compact configuration for storage or transport. This is achieved by removing the fasteners 45 to disconnect the horizontal stabilizing members 42 from the vertical support 18. The inclined stabilizing members 20 are then pivoted inwards about the fasteners 26 toward the vertical support 18, and the horizontal stabilizing members are pivoted toward the inclined stabilizing members about the fasteners 40.

The lower and upper sections 50, 52, respectively, of the boom 48 are folded relative to each other about the hinge 56 and then to the compact configuration depicted in FIG. 8. As shown, the sections of the boom and the vertical support 18 are close to each other along their lengths. In this folded configuration, the hoist system can then be placed, for example, in a rigid container or in padded bag for transport or storage.

Thus, the hoist system provides a number of advantages, including a simple construction, portability, ease of assembly, adjustability, and a strong and lightweight construction. The clamping members 28 and 62 enable the hoist system to be readily mounted to and demounted from rails, allowing the hoist system to be easily moved to different locations. The lightweight construction enhances portability and enables the hoist system to be used by a single individual.

It will be understood that the hoist system in accordance with the invention also has utility in applications other than lifting and lowering persons and objects between different elevations. For example, the hoist system may be used on railways for lifting rails and other objects and materials during maintenance operations, or for loading objects onto vehicles.

The foregoing description of the preferred embodiment of the invention has been presented to illustrate the principles of the invention and not to limit the invention to the particular embodiment illustrated. The scope of the invention is defined by the embodiments encompassed within the following claims and their equivalents.

What is claimed is:

1. A portable hoist system for mounting to first and second rails, comprising:

a vertical support having a lower end and an upper end, a first clamping member disposed at the lower end, said first clamping member being detachably mountable to a first rail;

a boom connected to said vertical support, said boom having a lower end and an upper end, a second clamping member disposed at the lower end of said boom, said second clamping member being detachably mountable to a second rail, said boom extending upward from said second clamping member at an acute angle relative to the horizontal and approximately perpendicularly relative to the direction of the first and second rails; and a hoist fastened to said boom.

2. The hoist system of claim 1, comprising first and second inclined stabilizing members extending downward at an acute angle from opposed sides of said vertical support, said first and second inclined stabilizing members and said vertical support being positioned substantially in a common plane.

3. The hoist system of claim 2, comprising a shoe at a lower end of each of said first and second inclined stabilizing members for positioning on an upper surface of the first rail, the shoes being pivotally adjustable with respect to the corresponding first and second inclined stabilizing member.

4. The hoist system of claim 3, comprising a rigid horizontal stabilizer connected to the lower ends of said vertical support and said first and second inclined stabilizing members.

5. The hoist system of claim 4, wherein said horizontal stabilizer comprises first and second horizontal stabilizing members, said first horizontal stabilizing member being attached at one end to said first inclined stablizing member and at an opposite end to said first clamping member, said second horizontal stabilizing member being attached at one end to said second inclined stablizing member and at an opposite end to said vertical support, said first and second horizontal stabilizing members being detachable from said vertical support to enable said first and second horizontal stabilizing members and said first and second inclined stabilizing members to be pivoted toward said vertical support into a folded position.

6. The hoist system of claim 5, wherein said first and second horizontal stabilizing members each comprise a vertical member extending downward therefrom and adapted to surround the first rail so as to limit lateral movement of the shoes relative to the first rail.

7. The hoist system of claim 1, wherein said boom is foldable.

8. The hoist system of claim 7, wherein said boom is comprised of an upper section and a lower section hingedly connected thereto, said boom having a use position in which said upper and lower sections are collinear, and said upper and lower sections being pivotable relative to each other from the use position to a folded position.

9. The hoist system of claim 8, wherein said upper section defines a plurality of longitudinally spaced bores to which said hoist is selectively fastenable.

10. The hoist system of claim 1, comprising a first cable connecting the upper end of said vertical support and said second clamping member, means for adjusting the tension in said first cable, and a second cable connecting the upper end of said vertical support and the upper end of said boom.

11. The hoist system of claim 1, wherein the first and second rails each include opposed vertical side faces and an enlarged upper end, said first and second clamping members each comprise opposed threaded bolts for selectively fastening to the the vertical side faces of the first and second rails, respectively, below the enlarged upper ends thereof.

12. The hoist system of claim 1, wherein said hoist is self-operable and comprises a harness for supporting an individual.

13. A portable hoist system for mounting to first and second rails, comprising:

a vertical support having a lower end and an upper end, a first clamping member disposed at the lower end, said first clamping member being detachably mountable to a first rail;

first and second inclined stabilizing members extending downward at an acute angle from opposed sides of said vertical support, said first and second inclined stabilizing members and said vertical support being positioned substantially in a common plane;

a horizontal stabilizer connected to the lower ends of said vertical support and said first and second inclined stabilizing members;

a boom connected to said vertical support, said boom having a lower end and an upper end, a second clamping member disposed at the lower end of said boom, said second clamping member being detachably mountable to a second rail, said boom extending upward from said second clamping member at an acute angle relative to the horizontal and approximately perpendicularly relative to the direction of the first and second rails;

a tensioning member extending between the upper end of said vertical support and said second clamping member, and between the upper end of said vertical support and the upper end of said boom; and a hoist provided on said boom.

14. The hoist system of claim 13, wherein said boom is foldable and comprised of an upper section and a lower section hingedly connected thereto, said boom having a use position in which said upper and lower sections are collinear, and said said upper and lower sections being pivotable relative to each other from the use position to a folded position.

15. The hoist system of claim 14, wherein said boom defines a plurality of longitudinally spaced bores to which said hoist is selectively mountable.

16. The hoist system of claim 13, wherein the first and second rails each include opposed vertical side faces and an enlarged upper end, said first and second clamping members each comprise opposed threaded bolts for selectively fastening to the the vertical side faces of the first and second rails, respectively, below the enlarged upper ends thereof.

17. The hoist system of claim 13, wherein said hoist is self-operable and comprises a harness adapted to support an individual.

18. A portable hoist system for mounting to first and second rails, comprising:

a vertical support;

a boom connected to said vertical support and extending upward at an acute angle relative to the horizontal and approximately perpendicularly relative to the direction of the first and second rails;

clamping means for detachably mounting said vertical support and said boom to the first and second rails, respectively; and a hoist fastened to said boom.

19. The hoist system of claim 18, comprising first and second inclined stabilizing members extending downward at an acute angle from opposed sides of said vertical support, said first and second inclined stabilizing members and said vertical support being positioned substantially in a common plane, and a horizontal stabilizer connected to a lower end of each said vertical support and said first and second inclined stabilizing members.

20. The hoist system of claim 19, wherein said boom is comprised of an upper section and a lower section hingedly connected thereto, said boom having a use position in which said upper and lower sections are collinear, and said upper and lower sections being pivotable relative to each other from the use position to a folded position, and said horizontal stabilizer comprises first and second horizontal stabilizing members, said first horizontal stabilizing member being attached at one end to said first inclined stablizing member and at an opposite end to said vertical support, said second horizontal stabilizing member being attached at one end to said second inclined stablizing member and at an opposite end to said vertical support, said first and second horizontal stabilizing members being detachable from said vertical support to enable said first and second horizontal stabilizing members and said first and second inclined stabilizing members to be pivoted toward said vertical support.

* * * * *